US012667204B2

(12) United States Patent
Shen

(10) Patent No.: US 12,667,204 B2
(45) Date of Patent: Jun. 30, 2026

(54) OUTDOOR SEAT WITH INTEGRATED PROTECTIVE COVER

(71) Applicant: Terrace Living Co., Inc., Temecula, CA (US)

(72) Inventor: Zhenyong Shen, Hangzhou (CN)

(73) Assignee: Terrace Living Co., Inc., Temecula, CA (US)

( * ) Notice: Subject to any disclaimer, the term of this patent is extended or adjusted under 35 U.S.C. 154(b) by 239 days.

(21) Appl. No.: 18/397,356

(22) Filed: Dec. 27, 2023

(65) Prior Publication Data

US 2025/0017392 A1 Jan. 16, 2025

(30) Foreign Application Priority Data

Jul. 14, 2023 (CN) ..... 202310868759.0

(51) Int. Cl.
*A47C 31/11* (2006.01)

(52) U.S. Cl.
CPC ..... *A47C 31/11* (2013.01)

(58) Field of Classification Search
CPC ..... A47C 31/11
See application file for complete search history.

(56) References Cited

U.S. PATENT DOCUMENTS 807,279 A 12/1905 Kandle
2,172,890 A 9/1939 Phillips
4,273,380 A 6/1981 Silvestri
4,600,238 A 7/1986 Goodford
4,725,094 A 2/1988 Greer
4,877,288 A 10/1989 Lee
5,005,901 A 4/1991 Hinde
5,080,431 A 1/1992 Frazier
5,099,530 A 3/1992 Scott
5,150,945 A 9/1992 Aupperlee et al.
5,308,139 A 5/1994 Rieger
5,331,956 A 7/1994 Bailey
5,414,881 A 5/1995 Terrazas
6,030,034 A 2/2000 Plohetski
6,086,152 A 7/2000 Zeller
6,158,805 A * 12/2000 Blaney ..... B60N 2/6009 297/184.11
6,393,638 B1 5/2002 MacColl
(Continued)

FOREIGN PATENT DOCUMENTS

CN 217792117 U 11/2022
DE 102015016031 A1 8/2016
(Continued)

*Primary Examiner* — David R Dunn
*Assistant Examiner* — Tania Abraham
(74) *Attorney, Agent, or Firm* — Womble Bond Dickinson (US) LLP

(57) ABSTRACT

An outdoor seat includes a frame, a seat cushion, a back cushion, and a cover. The frame includes a rear rail that defines a rear bottom portion of the frame. The back cushion includes a drop cloth that has a bottom section which includes a storage pocket. The cover is secured to the drop cloth within the storage pocket. The cover has a packed state in which the cover is enclosed in the storage pocket and a deployed state in which the cover envelopes the frame, the seat cushion, and the back cushion therein.

17 Claims, 4 Drawing Sheets

(56) References Cited

U.S. PATENT DOCUMENTS

| | | | | |
|---|---|---|---|---|
| 6,626,491 | B1 * | 9/2003 | Blome | A45F 4/08 297/229 |
| 6,655,736 | B1 * | 12/2003 | Arenas | B60N 2/6063 297/229 |
| 6,709,055 | B2 | 3/2004 | Gengler et al. | |
| 7,204,551 | B2 | 4/2007 | Kahan | |
| D551,891 | S | 10/2007 | Kaiser et al. | |
| 7,469,962 | B2 | 12/2008 | Paulin | |
| 7,690,725 | B1 | 4/2010 | Rawlings | |
| 8,863,327 | B1 | 10/2014 | Winn | |
| 9,277,828 | B2 | 3/2016 | Watson | |
| D806,444 | S | 1/2018 | Sheldrake | |
| 2001/0035672 | A1 | 11/2001 | Graff | |
| 2003/0117001 | A1 | 6/2003 | Gengler | |
| 2006/0061154 | A1 | 3/2006 | Kahan | |
| 2012/0212019 | A1 * | 8/2012 | Rodriguez | A47C 31/11 297/219.1 |
| 2015/0074912 | A1 | 3/2015 | Simon et al. | |
| 2015/0113734 | A1 | 4/2015 | Arabo | |
| 2015/0123439 | A1 | 5/2015 | Jordan | |
| 2017/0290442 | A1 | 10/2017 | Rause | |
| 2017/0303699 | A1 | 10/2017 | Howe | |
| 2019/0133336 | A1 | 5/2019 | Ennis | |
| 2022/0160130 | A1 | 5/2022 | Works | |
| 2022/0330712 | A1 | 10/2022 | Adams | |

FOREIGN PATENT DOCUMENTS

| | | | |
|---|---|---|---|
| EP | 4119008 | A1 | 1/2023 |
| GB | 191319076 | A | 5/1914 |

* cited by examiner

OUTDOOR SEAT WITH INTEGRATED PROTECTIVE COVER

CROSS-REFERENCE TO RELATED APPLICATION

This application claims benefit of, and priority to, Chinese Patent Application No. 2023108687590, filed Jul. 14, 2023, the entire contents of which are hereby incorporated by reference.

BACKGROUND

1. Technical Field

The present disclosure relates to outdoor seating and, more specifically, to an outdoor seat with an integrated protective cover.

2. Discussion of Related Art

By its nature, outdoor furniture is exposed to the elements. As such, when not in use, many users cover the outdoor furniture to protect or preserve the outdoor furniture from the elements. Protecting the outdoor furniture can prevent discoloration or fading of the outdoor furniture. Protecting the outdoor furniture can prevent or reduce the possibility of the outdoor furniture retaining water such that the outdoor furniture is dry when used.

When not in use, protective covers must be stored separate from the outdoor furniture. Storing the protective covers separate from the outdoor furniture can cause the covers to get damaged when not in use and/or can cause the covers to be misplaced or lost.

SUMMARY

This disclosure relates generally to an outdoor seat with an integrated protective cover that is stored and concealed when not in use. The cover may be disposed within the frame of the outdoor seat when not in use such that the cover, and the storage pocket containing the cover, is concealed from view.

In an aspect of the present disclosure, an outdoor seat includes a frame, a seat cushion, a back cushion, and a cover. The frame includes a rear rail that defines a rear bottom portion of the frame. The back cushion includes a drop cloth that has a bottom section which includes a storage pocket. The cover is secured to the drop cloth within the storage pocket. The cover has a packed state in which the cover is enclosed in the storage pocket and a deployed state in which the cover envelopes the frame, the seat cushion, and the back cushion therein.

In aspects, the drop cloth has a stowed position in which the storage pocket is disposed within the frame forward of the rear rail such that the storage pocket is concealed within the frame. The cover may be secured to the interior surface of the drop cloth within the storage pocket. The cover may be non-removably or removably secured to the interior surface of the drop cloth within the storage pocket.

In some aspects, the back cushion includes a mount section that is disposed about a back support of the frame. The mount section is slidably removable from over the back support of the frame. The drop cloth may extend from the mount section.

In particular aspects, the cover has an open bottom end that is disposed below the frame when the cover is in the deployed state. The open bottom end of the cover includes a tensioning element. The tensioning element may draw the open bottom end inward in the deployed state of the cover such that the open bottom end is substantially within a footprint of the frame.

In another aspect of the present disclosure, an outdoor seat includes a frame, a back cushion, and a cover. The frame has a front rail, a rear rail, and a back support. The back cushion includes a mount section and a drop cloth. The mount section is disposed over the back support to secure the back cushion to the frame. The drop cloth extends from a bottom edge of the mount section. The drop cloth has a bottom section that includes a storage pocket. The cover is secured to the drop cloth within the storage pocket. The cover has a packed state in which the cover is enclosed in the storage pocket and a deployed state in which the cover envelopes the frame and the back cushion therein.

In aspects, the drop cloth has a stowed position in which the storage pocket is disposed within the frame forward of the rear rail such that the storage pocket is concealed within the frame. The cover may be secured to an interior surface of the drop cloth within the storage pocket. The cover may be non-removably or removably secured to the interior surface of the drop cloth within the storage pocket.

In some aspects, the cover is attached to the interior surface of the drop cloth along an attachment line. The attachment line may be closer to a center of the cover than to an open bottom end of the cover. The mount section may be slidably removable from over the back support of the frame. The drop cloth may include a retention system that retains the drop cloth in a raised position in which the bottom section of the drop cloth is adjacent a top of the back cushion.

In certain aspects, the cover has an open bottom end that is disposed below the frame when the cover is in the deployed state. The open bottom end of the cover may include a tensioning element that draws the open bottom end inward in the deployed state of the cover such that the open bottom end is substantially within a footprint of the frame.

In another aspect of the present disclosure, a method of covering an outdoor seat includes removing a cover from a storage pocket with the cover attached to an interior surface of a drop cloth of the back cushion. The drop cloth may extend downward from a mount section of the back cushion. The mount section is secured to the back support of the frame of the outdoor seat. The method also includes deploying the cover over the frame, the back cushion, and a seat cushion of the outdoor seat with the cover remaining attached to the interior surface of the drop cloth when deployed.

In aspects, the method includes accessing the storage pocket by removing the drop cloth from within the frame in which the storage pocket is concealed within the frame. Accessing the storage pocket may include removing the storage pocket from a stowed position in which the storage pocket is disposed forward of a rear rail of the frame.

Further, to the extent consistent, any of the embodiments or aspects described herein may be used in conjunction with any or all of the other embodiments or aspects described herein.

BRIEF DESCRIPTION OF THE DRAWINGS

Various aspects of the present disclosure are described hereinbelow with reference to the drawings, which are not necessarily drawn to scale, which are incorporated in and constitute a part of this specification, wherein.

DETAILED DESCRIPTION

Figure 2:
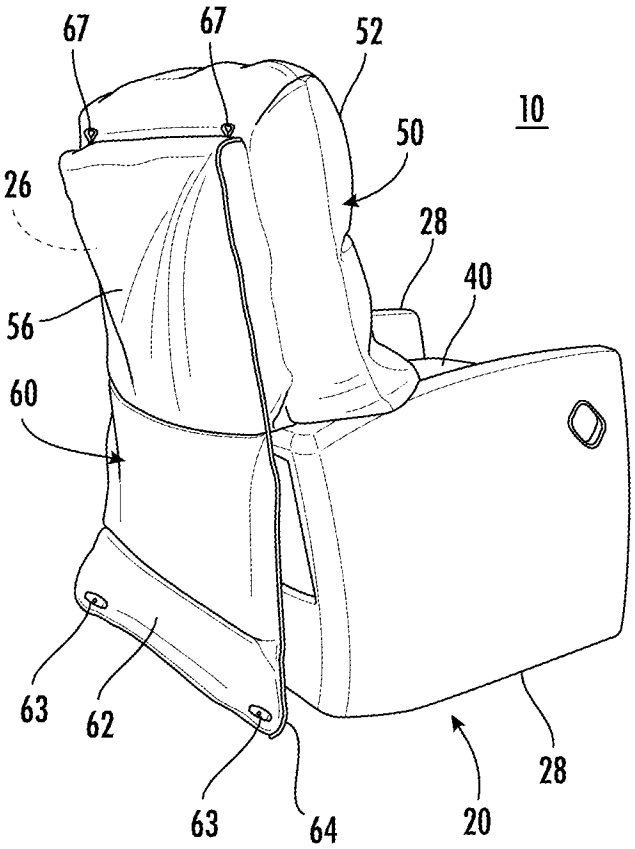
FIG. 2 is a rear perspective view of the outdoor seat of FIG. 1 with the storage pocket in a free position hanging from a drop cloth of the outdoor seat.

The present disclosure will now be described more fully hereinafter with reference to example embodiments thereof with reference to the drawings in which like reference numerals designate identical or corresponding elements in each of the several views. These example embodiments are described so that this disclosure will be thorough and complete, and will fully convey the scope of the disclosure to those skilled in the art. Features from one embodiment or aspect can be combined with features from any other embodiment or aspect in any appropriate combination. For example, any individual or collective features of method aspects or embodiments can be applied to apparatus, product, or component aspects or embodiments and vice versa. The disclosure may be embodied in many different forms and should not be construed as limited to the embodiments set forth herein; rather, these embodiments are provided so that this disclosure will satisfy applicable legal requirements. As used in the specification and the appended claims, the singular forms "a," "an," "the," and the like include plural referents unless the context clearly dictates otherwise. In addition, while reference may be made herein to quantitative measures, values, geometric relationships or the like, unless otherwise stated, any one or more if not all of these may be absolute or approximate to account for acceptable variations that may occur, such as those due to manufacturing or engineering tolerances or the like.

Figure 1:
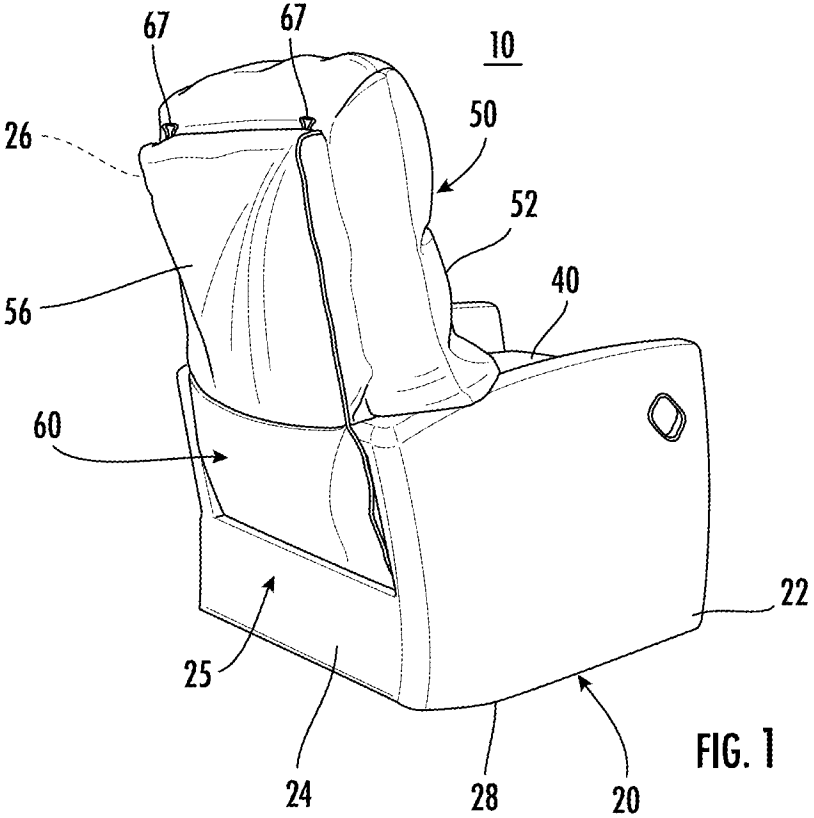
FIG. 1 is a rear perspective view of an outdoor seat provided in accordance with embodiments of the present disclosure with a storage pocket in a stowed position.

Referring now to FIG. 1, an outdoor seat 10 is provided in accordance with an embodiments of the present disclosure. The outdoor seat 10 includes a frame 20, a seat cushion 40, and a back cushion 50. The frame 20 may include a front rail 22, a rear rail 24, and side rails 28 that extend between the front rail 22 and the rear rail 24. The frame 20 may include a back support 26 and a seat support (not shown). The back support 26 and the seat support (not shown) may be fixed or may be movable between an upright configuration and a reclined configuration. The front rail 22, the rear rail 24, and the side rails 28 of the frame 20 define a footprint of the frame 20 which is the area below the extremities of the frame 20. The rear rail 24 may define a rear bottom portion 25 of the frame 20.

With additional reference to FIG. 2, the back cushion 50 includes a back pad 52 and a mount section 56. The mount section 56 is secured to the back support 26 such that the back pad 52 is positioned on the front of the back support 26. The mount section 56 may be removably secured to the back support 26. In some embodiments, the mount section 56 may be non-removably secured to the back support 26. The back cushion 50 includes a drop cloth 60 that extends downward from a rear side of the back cushion 50. The drop cloth 60 includes storage pocket 64 that is defined along a bottom section 62 of the drop cloth 60. The bottom section 62 including the storage pocket 64 has a stowed position (FIG. 1) in which the bottom section 62 is disposed within the frame 20 forward of the rear rail 24 such that the storage pocket 64 is hidden or not visible. The bottom section 62 may have a free position (FIG. 2) in which the drop cloth 60 hangs free from the mount section 56. In the free position, the storage pocket 64 may be visible.

Figure 4:
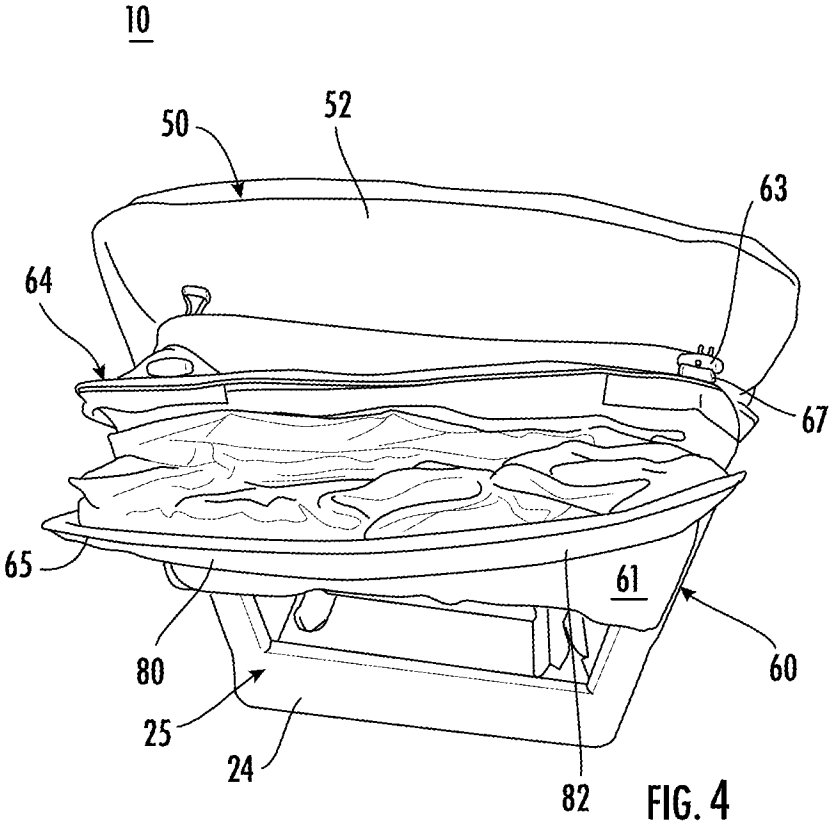
FIG. 4 is a top perspective view of the storage pocket with a closure of the storage pocket open showing a cover disposed within a cavity of the storage pocket.
Figure 3:
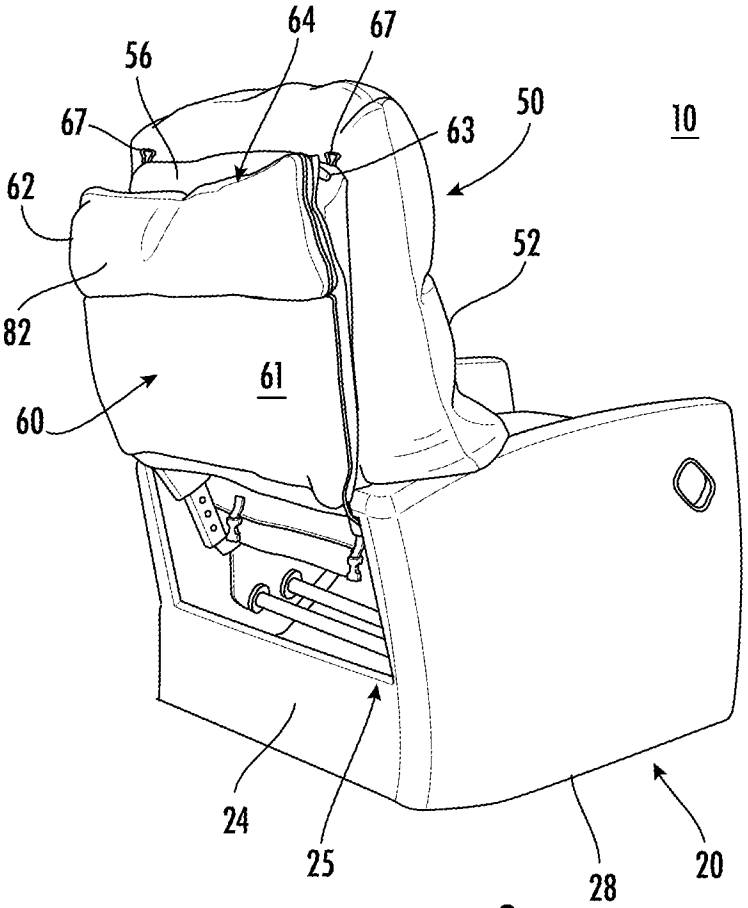
FIG. 3 is a rear perspective view of the outdoor seat of FIG. 1 with the storage pocket positioned adjacent a top of a backrest support.

Referring now to FIGS. 3 and 4, the storage pocket 64 may include a closure 65 to close the storage pocket 64. The closure 65 may be disposed along a bottom edge of the drop cloth 60. In some embodiments, the closure 65 is along a top edge of the storage pocket 64 and thus, spaced apart from the bottom edge of the drop cloth 60. The closure 65 may be a zipper, a hook and loop fastener system, a snap and button system, or a button system. The closure 65 selectively closes the storage pocket 64 to allow or prevent access to contents of the storage pocket 64.

Figure 5:
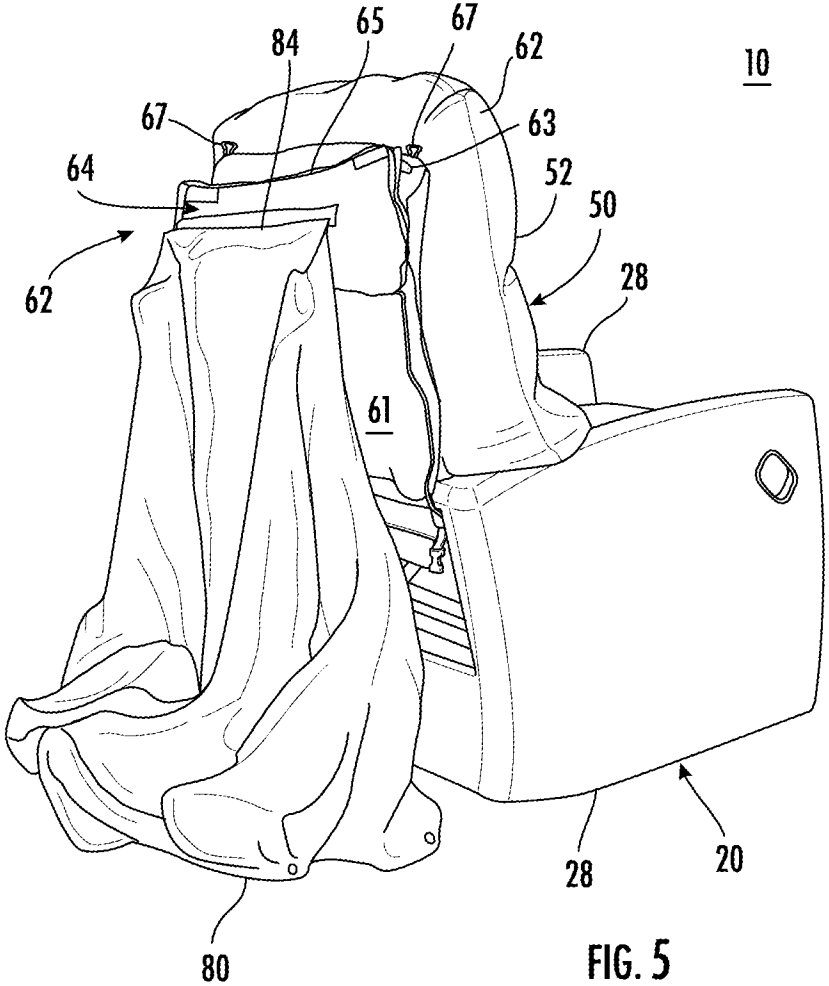
FIG. 5 is a rear perspective view of the outdoor seat of FIG. 1 with the cover substantially removed from the storage pocket.

The storage pocket 64 defines a cavity that is sized and dimensioned to hold a cover 80 when the cover 80 is in a packed state. The cover 80 is disposed within the storage pocket 64 when the closure 65 is closed. The cover 80 is secured to the drop cloth 60 within the storage pocket 64 along an attachment line 84 (FIG. 5). The attachment line 84 may be positioned relative to the cover 80 such that when deployed over the outdoor seat 10 the drop cloth 60 is in a raised position as shown in FIG. 5 with the bottom section 62 positioned adjacent a top of the back support 26 of the frame 20. As shown, the attachment line 84 is secured to the interior surface 61 of the drop cloth 60 which faces an inside of the frame 20 when the drop cloth 60 is disposed within the frame 20. In some embodiments, the cover 80 may be sewn to the drop cloth 60. In such embodiments, the cover 80 may be considered non-removable. In certain embodiments, the cover 80 may be secured to the drop cloth 60 by a hook and loop fastener system, a snap and button fastener system, buttons, or a zipper. In such embodiments, the cover 80 may be considered removable. A portion 82 of the cover 80 may form an interior surface 61 of the storage pocket 64. As shown in FIG. 4, the cover 80 is disposed within the storage pocket 64 in a stowed state.

In some embodiments, the drop cloth 60 includes a retention system to secure the drop cloth 60 in a raised position in which the bottom section 62 of the drop cloth 60 is adjacent the top of the back support 26 as shown in FIGS. 3-5. The retention system includes a first part or button 63 that is disposed in the bottom section 62 of the drop cloth 60. The button 63 may be a metal or polymer button. The button 63 may be secured to the inside surface 61, the outside surface, or the bottom of the bottom section 62. The retention system also includes a second part or snap 67 that is secured to the top of the back support 26. The snap 67 may be secured to a piece or strip of fabric that extends from the top of the back support 26. The first part 63 and the second part 67 are configured to engage one another to retain the drop cloth 60 in the raised position thereof. In certain embodiments, the first part may be a fabric loop or a tie and the second part may be the other of a fabric loop or a tie that is configured to engage the first part to retain the drop cloth 60 in the raised position.

Figure 6:
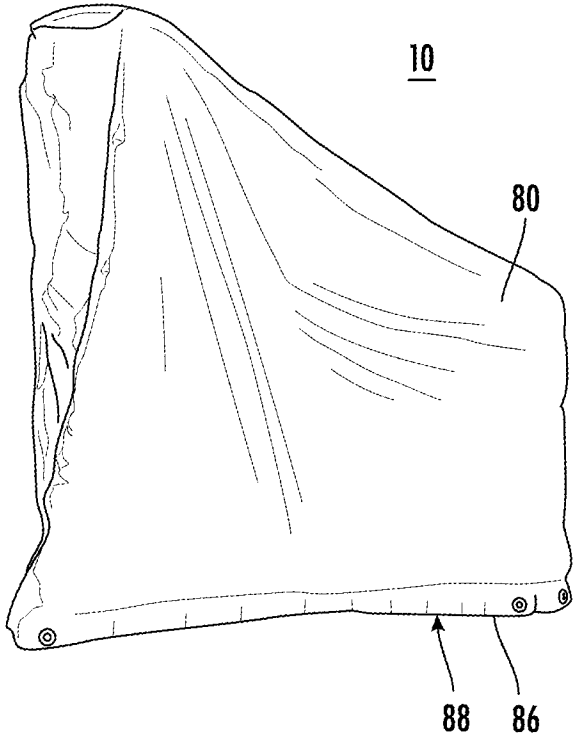
FIG. 6 is a side perspective view of the outdoor seat of FIG. 1 with the cover disposed over the outdoor seat.

Referring now to FIGS. 5 and 6, the cover 80 is substantially removed from within the storage pocket 64 such that the material of the cover 80 is expanded from the stowed state. The cover 80 is sized and dimensioned to fit over the outdoor seat 10 as shown in a deployed state in FIG. 6. In the deployed state, the cover 80 forms an outer upper surface of the entire outdoor seat 10 to protect the outdoor seat 10 from the elements. When in the deployed state, the securement of the cover 80 to the drop cloth 60 may cause the drop cloth 60 to be folded up such that the bottom section 62 of the drop cloth 60 is adjacent a top of the back pad 52 as shown in FIG. 5. In some embodiments, the cover 80 may include a tightening element 88 that extends at least partially about an open bottom end 86 of the cover 80. The tightening element 88 may be a drawstring disposed within a tunnel that allows for the tightening or drawing closed of the open bottom end 86 such that the cover 80 is retained over the outdoor seat 10. When drawn closed, the open bottom end 86 may be disposed underneath the frame 20 of the outdoor seat 10, e.g., substantially within the footprint of the frame defined by the side rails 28, the front rail 22, or the rear rail 24.

As shown, the outdoor seat 10 is shown in a single position seat or chair; however, the outdoor seat 10 can be a multi-position seat such as a sofa, couch, or a sectional. When the outdoor seat 10 is a multi-position seat, the cover 80 may be stowed in a single storage pocket of a seat similar to the cover 80 of the outdoor seat 10 above with the cover 80 covering multiple seats. In some embodiments, a multi-position seat may have multiple covers 80 that each cover one or more seats of the multi-position seat. In certain embodiments, the multiple covers 80 may secure together such that the multiple covers 80 protect the entire multi-position seat.

As shown, the outdoor seat 10 is shown in a single position; however, the outdoor seat 10 may be capable of multiple positions. For example, the outdoor seat 10 may have an upright position as shown in FIGS. 1-6 and may have one or more reclined positions in which the back rest is reclined relative to the seat. In some embodiments, the seat may recline and or translate relative to the back rest in the one or more reclined positions.

Figure 7:
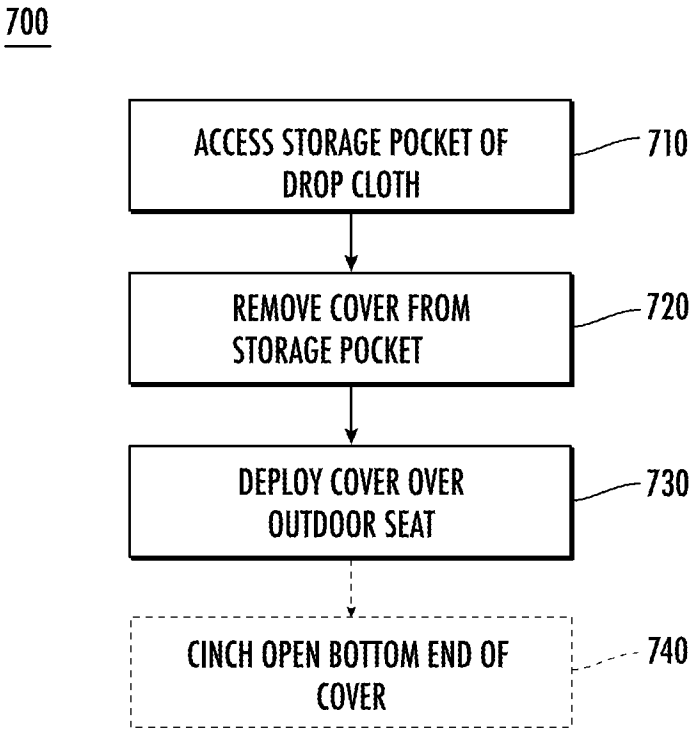
FIG. 7 is a flowchart of a method of covering an outdoor seat with an integrated cover in accordance with embodiments of the present disclosure.

With reference to FIG. 7, a method of deploying an integrated protective cover for an outdoor seat is described in accordance with embodiments of the present disclosure with reference to the outdoor seat 10 of FIGS. 1-6 and is referred to generally as method 700. To deploy the cover 80, the storage pocket 64 of the drop cloth 60 is accessed by lifting the drop cloth 60 (Step 710). To access the storage pocket 64 of the drop cloth 60, the drop cloth 60 may be pulled such that the bottom section 62 of the drop cloth 60 is withdrawn from within the frame 20 as shown in FIG. 2. Accessing the storage pocket 64, may include lifting the bottom section 62 of the storage pocket 64 such that the storage pocket 64 is disposed adjacent a top of the back support 26 as shown in FIG. 3.

With the storage pocket 64 accessed, the cover 80 is removed from the storage pocket 64 (Step 720). To remove the cover 80 from storage pocket 64, the closure 65 of the storage pocket 64 may be actuated to access the cover 80 stowed within the storage pocket 64. Actuating the closure 65 may include unzipping or separating two sides of the closure 65 to access a cavity of the storage pocket 64. With the cover 80 accessed, the cover 80 is substantially removed from the storage pocket 64 as shown in FIG. 5.

With the cover 80 substantially removed from the storage pocket 64, the open bottom end 86 of the cover 80 is pulled over the outdoor seat 10 such that the open bottom end 86 surrounds the bottom of the outdoor seat 10 as shown in FIG. 6 (Step 730). As detailed above, the cover 80 is secured to the drop cloth 60 within the storage pocket 64 such that when open bottom end 86 surrounds the bottom of the outdoor seat 10, the cover 80 may urge the drop cloth 60 to the raised position such that the bottom section 62 of the drop cloth 60 is adjacent the top of the back support 26. In some embodiments, the method 700 includes using a retention system to secure the drop cloth 60 in the raised position prior to surrounding the bottom of the outdoor seat 10 with the open bottom end 86 of the cover 80. The drop cloth 60 being in the raised position may increase tension across the cover 80 over the seat cushion 40 such that liquids flow off of the cover 80 and pools of liquid are prevented from sitting over the seat cushion 40. Preventing pools of liquid over the seat cushion 40 may keep the seat cushion 40 dry when covered and/or prevent liquids from seeping through the cover 80.

With the cover 80 deployed over the outdoor seat 10, the open bottom end 86 of the cover 80 may be cinched about the frame 20 (Step 740). The tightening element 88 may include a drawstring or other mechanism to reduce the dimension of the open bottom end 86 such that the open bottom end 86 is substantially beneath a footprint of the frame 20. The tightening element 88 may include a lock, e.g., a slide lock, to maintain tension in the tightening element 88. In certain embodiments, the tightening element 88 may be an elastic band that is secured about the open bottom end 86 such that when the open bottom end 86 is disposed below the frame 20, the tightening element 88 draws the open bottom end 86 of the cover 80 within the footprint of the frame 20. In such of embodiments, the open bottom end 86 of the cover 80 may be self-cinching or self-biased. Cinching the open bottom end 86 may tension portions of the cover such that liquids flow off of the surface of the cover 80 and/or prevent liquids from pooling on the cover 80. In some embodiments, the cover 80 may be sized and dimensioned to match contours of the frame 20 and/or the seat cushion 40, 50 of the outdoor seat 10.

Figure 8:
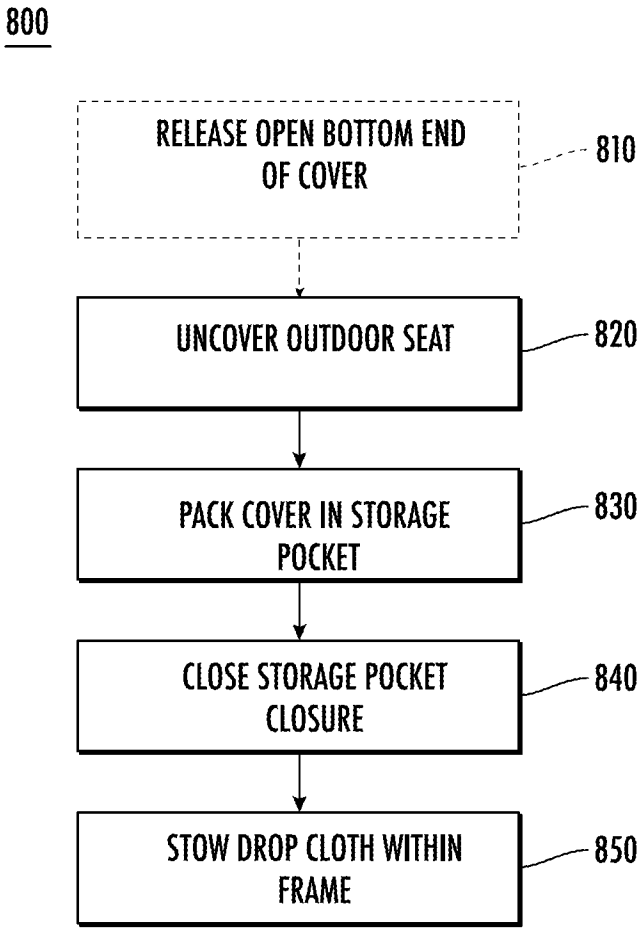
FIG. 8 is a flow chart of a method of stowing an integrated cover of an outdoor seat in accordance with embodiments of the present disclosure.

Referring now to FIG. 8, a method of stowing an integrated cover of an outdoor seat is described in accordance with embodiments of the present disclosure with reference to the outdoor seat 10 of FIGS. 1-6 and is referred to generally as method 800. When the integrated cover 80 is in a deployed state, an open bottom end 86 of the cover 80 may be secured or cinched about the frame. In such embodiments, the method 800 includes releasing a tightening element 88 of the cover 80 such that the open bottom end 86 may be lifted over the front of the outdoor seat 10 (Step 810). In some embodiments, a lock of the tightening element 88 may be released to allow the open bottom end 86 to be lifted over the front of the outdoor seat 10.

With the open bottom end 86 lifted over the front of the outdoor seat 10, the outdoor seat 10 is uncovered such that the seat cushion 40 and the back cushion 50 are exposed with the cover 80 positioned on the rear of the outdoor seat 10 as shown in FIG. 5 (Step 820). With the seat uncovered, the cover 80 is packed into the cavity of the storage pocket 64 (Step 830). The cover 80 may be packed by folding, rolling, stuffing, or any combination thereof such that the cover 80 is disposed within the cavity of the storage pocket 64. As detailed above, the cover 80 is secured to the drop cloth 60 along the attachment line 84 which is positioned within the storage pocket 64 such that the cover 80 is integrated into the drop cloth 60. The securement of the cover 80 to the drop cloth 60 may aid in the packing of the cover 80 into the storage pocket 64. For example, the securement of the cover 80 may allow a user to roll the cover 80 into the storage pocket 64. In some embodiments, the securement of the cover 80 may aid a user in folding the cover 80 into the storage pocket 64.

When the cover 80 is packed into the cavity of the storage pocket 64, the closure 65 of the storage pocket 64 is closed (Step 840). With the closure 65 of the storage pocket 64 closed, the bottom section 62 of the drop cloth 60, including the storage pocket 64, is stowed within the rear rail 24 of the frame 20 such that the storage pocket 64 is concealed within the frame 20 as shown in FIG. 1 (Step 850).

Although the method operations or steps are described in a specific order, it should be understood that other operations and steps may be performed in between described operations and steps, described operations and steps may be adjusted so that they occur at slightly different times, or the described operations and steps may occur in any order unless otherwise specified.

While several embodiments of the disclosure have been shown in the drawings, it is not intended that the disclosure be limited thereto, as it is intended that the disclosure be as broad in scope as the art will allow and that the specification be read likewise. Any combination of the above embodiments is also envisioned and is within the scope of the appended claims. Therefore, the above description should not be construed as limiting, but merely as exemplifications of particular embodiments. Those skilled in the art will envision other modifications within the scope of the claims appended hereto.

What is claimed:

1. An outdoor seat comprising:

a frame having a rear rail defining a rear bottom portion of the frame;

a seat cushion;

a back cushion including a drop cloth having a bottom section, the bottom section including a storage pocket; and a cover secured to the drop cloth within the storage pocket, the cover having a packed state in which the cover is enclosed in the storage pocket and a deployed state in which the cover envelopes the frame, the seat cushion, and the back cushion therein, the drop cloth having a stowed position in which the storage pocket is disposed within the frame forward of the rear rail and concealed within the frame.

2. The outdoor seat according to claim 1, wherein the cover is secured to an interior surface of the drop cloth within the storage pocket.

3. The outdoor seat according to claim 2, wherein the cover is non-removably secured to the interior surface of the drop cloth within the storage pocket.

4. The outdoor seat according to claim 1, wherein the back cushion includes a mount section, the mount section disposed about a back support of the frame.

5. The outdoor seat according to claim 4, wherein the mount section is slidably removable from over the back support of the frame.

6. The outdoor seat according to claim 4, wherein the drop cloth extends from the mount section.

7. The outdoor seat according to claim 1, wherein the cover has an open bottom end, the open bottom end disposed below the frame when the cover is in the deployed state.

8. The outdoor seat according to claim 7, wherein the open bottom end of the cover includes a tensioning element, the tensioning element drawing the open bottom end inward in the deployed state of the cover such that the open bottom end is substantially within a footprint of the frame.

9. An outdoor seat comprising:

a frame having a front rail, a rear rail, and a back support;

a back cushion including a mount section and a drop cloth, the mount section disposed over the back support to secure the back cushion to the frame, the drop cloth extending from a bottom edge of the mount section, the drop cloth having a bottom section including a storage pocket; and a cover secured to the drop cloth within the storage pocket, the cover having a packed state in which the cover is enclosed in the storage pocket and a deployed state in which the cover envelopes the frame and back cushion therein, the drop cloth having a stowed position in which the storage pocket is disposed within the frame forward of the rear rail and concealed within the frame.

10. The outdoor seat according to claim 9, wherein the cover is secured to an interior surface of the drop cloth within the storage pocket.

11. The outdoor seat according to claim 10, wherein the cover is non-removably secured to the interior surface of the drop cloth within the storage pocket.

12. The outdoor seat according to claim 9, wherein the cover is attached to the interior surface of the drop cloth along an attachment line, the attachment line closer to a center of the cover than to an open bottom end of the cover.

13. The outdoor seat according to claim 9, wherein the cover has an open bottom end, the open bottom end disposed below the frame when the cover is in the deployed state.

14. An outdoor seat comprising:

a frame having a front rail, a rear rail, and a back support;

a back cushion including a mount section and a drop cloth, the mount section disposed over the back support to secure the back cushion to the frame, the drop cloth extending from a bottom edge of the mount section, the drop cloth having a bottom section including a storage pocket; and a cover secured to the drop cloth within the storage pocket, the cover having a packed state in which the cover is enclosed in the storage pocket and a deployed state in which the cover envelopes the frame and back cushion therein, the drop cloth including a retention system that retains the drop cloth in a raised position thereof in which the bottom section of the drop cloth is adjacent a top of the back cushion.

15. The outdoor seat according to claim 14, wherein the open bottom end of the cover includes a tensioning element, the tensioning element drawing the open bottom end inward in the deployed state of the cover such that the open bottom end is substantially within a footprint of the frame.

16. A method of covering an outdoor seat, the method comprising:

removing a cover from a storage pocket with the cover attached to an interior surface of a drop cloth of the back cushion, the drop cloth extending downward from a mount section of the back cushion, the mount section secured to a back support of a frame of the outdoor seat;

deploying the cover over the frame, the back cushion, and a seat cushion of the outdoor seat, the cover remaining attached to the interior surface of the drop cloth when deployed; and accessing the storage pocket concealed within the frame by removing the drop cloth from within the frame.

17. The method according to claim 16, wherein accessing the storage pocket includes removing the storage pocket from a stowed position in which the storage pocket is disposed forward of a rear rail of the frame.

* * * * *